US010590688B2

(12) United States Patent
Salice

(10) Patent No.: US 10,590,688 B2
(45) Date of Patent: Mar. 17, 2020

(54) LIFTING SYSTEM FOR LEAVES OF FURNITURE

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 64 days.

(21) Appl. No.: 15/551,097

(22) PCT Filed: Feb. 15, 2016

(86) PCT No.: PCT/EP2016/053163

§ 371 (c)(1),
(2) Date: Aug. 15, 2017

(87) PCT Pub. No.: WO2016/131770

PCT Pub. Date: Aug. 25, 2016

(65) Prior Publication Data

US 2018/0058123 A1 Mar. 1, 2018

(30) Foreign Application Priority Data

Feb. 17, 2015 (IT) ..... MI2015A0221

(51) Int. Cl.
*E05F 1/10* (2006.01)
*E05F 5/02* (2006.01)
(Continued)

(52) U.S. Cl.
CPC ..... *E05F 1/1041* (2013.01); *E05D 7/00* (2013.01); *E05D 11/00* (2013.01); *E05D 11/087* (2013.01);
(Continued)

(58) Field of Classification Search
CPC ..... E05F 1/1041; E05F 5/02; E05F 1/1058; E05D 7/00; E05D 11/087; E05D 11/00; E05D 3/14
See application file for complete search history.

(56) References Cited

U.S. PATENT DOCUMENTS 2,903,149 A * 9/1959 Turner ..... E05F 1/1058 16/290
3,763,519 A * 10/1973 Favre ..... E05F 1/105 16/72
(Continued)

FOREIGN PATENT DOCUMENTS

CN 1863978 A 11/2006
CN 103109029 A 5/2013
(Continued)

OTHER PUBLICATIONS

International Search Report and Written Opinion dated Apr. 20, 2016 issued in PCT/EP2016/053163.
(Continued)

*Primary Examiner* — Jeffrey O'Brien
(74) *Attorney, Agent, or Firm* — Scully, Scott, Murphy & Presser, P.C.

(57) ABSTRACT

A lifting system for leaves of furniture that oscillate about at least one horizontal axis comprises a supporting body which can be connected to a fixed portion of the piece of furniture, a system of articulated levers with a first lever and a second lever which connect the supporting body to a leaf of the piece of furniture, and elastic actuation elements which are functionally connected to the system of articulated levers in order to generate a rotation torque for the system of levers; the lifting system further comprises elements for increasing the rotation torque which cooperate with the elastic actuation elements in order to increase the rotation torque at least
(Continued)

along a portion of the oscillation in the direction for opening the leaf that includes the raised position of the leaf.

14 Claims, 6 Drawing Sheets

(51) Int. Cl.
*E05D 7/00* (2006.01)
*E05D 11/00* (2006.01)
*E05D 11/08* (2006.01)
*E05D 3/14* (2006.01)

(52) U.S. Cl.
CPC ..... *E05F 1/1058* (2013.01); *E05F 5/02* (2013.01); *E05D 3/14* (2013.01); *E05Y 2201/264* (2013.01); *E05Y 2201/492* (2013.01); *E05Y 2900/20* (2013.01)

(56) References Cited

U.S. PATENT DOCUMENTS 4,981,348 A * 1/1991 Prillard ..... B60J 3/0282 296/97.5
7,178,202 B2 * 2/2007 Hirtsiefer ..... E05D 3/14 16/286
7,240,974 B2 * 7/2007 Hirtsiefer ..... E05D 15/262 312/109
7,448,703 B2 * 11/2008 Kung ..... E05D 15/262 162/286
7,694,459 B2 * 4/2010 Brunnmayr ..... E05D 15/262 49/339
7,797,796 B2 * 9/2010 Migli ..... E05D 15/46 16/286
7,810,213 B2 * 10/2010 Brustle ..... E05F 1/1075 16/286
8,321,996 B2 * 12/2012 Hirtsiefer ..... E05D 3/14 16/286
8,376,480 B2 * 2/2013 Brunnmayr ..... E05D 3/06 312/319.2
8,894,162 B2 * 11/2014 Kashiwaguma ..... E05F 1/1058 312/319.2
8,959,709 B2 * 2/2015 Hasegawa ..... E05D 3/14 16/65
9,303,441 B2 * 4/2016 Bravo ..... E05F 1/1058
9,316,036 B2 * 4/2016 Collene ..... E05F 1/1058
9,631,411 B2 * 4/2017 Lutz ..... E05D 11/1064
9,682,660 B2 * 6/2017 Viklund ..... B60R 9/055
9,719,283 B2 * 8/2017 Holzapfel ..... E05F 1/1058
9,874,354 B2 * 1/2018 Jadhav ..... A47L 15/4261
9,903,145 B2 * 2/2018 Huber ..... E05F 1/1058
9,909,346 B2 * 3/2018 Holzapfel ..... E05D 15/401
10,087,669 B1 * 10/2018 Gnadinger ..... E05F 3/224
2006/0102402 A1 * 5/2006 Birk ..... B60R 21/38 180/89.17
2008/0134464 A1 * 6/2008 Salice ..... E05F 1/1058 16/84
2010/0024162 A1 * 2/2010 Walz ..... B60R 21/38 16/233
2010/0162847 A1 * 7/2010 Gassner ..... E05F 1/1058 74/490.07
2011/0083299 A1 * 4/2011 Krudener ..... E05D 7/0407 16/319
2013/0333291 A1 * 12/2013 Blum ..... E05F 1/1058 49/386
2015/0107574 A1 * 4/2015 White ..... E05F 1/1261 126/194
2015/0152675 A1 * 6/2015 Vanini ..... E05F 1/1276 312/326
2015/0377269 A1 * 12/2015 Haemmerle ..... F16B 12/14 248/122.1
2017/0044812 A1 * 2/2017 Schluge ..... E05F 1/1058
2017/0260785 A1 * 9/2017 Vanini ..... A47L 15/4261
2017/0328103 A1 * 11/2017 Brunnmayr ..... E05D 3/14
2017/0335611 A1 * 11/2017 Brunnmayr ..... E05D 15/262
2017/0350179 A1 * 12/2017 Salice ..... E05F 5/006
2018/0155974 A1 * 6/2018 Kirenci ..... E05F 5/006

FOREIGN PATENT DOCUMENTS

DE 27 33 927 A1 2/1979
EP 1148200 A2 10/2001
EP 1 296 011 A1 3/2003
JP 8-284523 10/1996
WO WO 2006/111236 A1 10/2006
WO WO 2007/045631 A1 4/2007
WO 2009/143980 A1 12/2009
WO 2012/059168 A1 5/2012
WO WO 2012/116866 A1 9/2012

OTHER PUBLICATIONS

Chinese Office Action dated Sep. 21, 2018 received in Chinese Patent Application No. 201680007768.9, together with an English-language translation.
Extended European Search Report dated Sep. 23, 2019 received in European Application No. 19 18 4991.8.

* cited by examiner

LIFTING SYSTEM FOR LEAVES OF FURNITURE

The present invention relates to a lifting system for leaves of furniture that oscillate according to at least one horizontal axis, and a support and lifting assembly for leaves of furniture which comprises such lifting system. In the furniture sector, the use is known of furniture that has leaves that can be lifted upwardly by way of an oscillating motion about at least one horizontal axis. Such leaves are in particular connected to a fixed body of the piece of furniture by way of hinges that are designed to allow the leaves to make this oscillating movement; for lifting the leaf there are adapted lifting systems, which conventionally comprise a supporting body that can be connected to the fixed portion of the piece of furniture, a system of articulated levers that connects the supporting body to a fixing element that can be connected to the leaf, and elastic actuation means that are functionally connected to a lever of the system of levers in order to generate a rotation torque such as to push the leaf toward a raised open position.

For example a lifting system is known which has a system of articulated levers which comprises a first lever and a second lever which are mutually articulated at one end thereof and are likewise connected rotatably at the other end respectively with the supporting body and with a fixing element which is arranged on the leaf of the piece of furniture.

Such conventional lifting system also comprises a gas cylinder actuator which is connected so that it can oscillate and is arranged between the supporting body and the first lever of the system of articulated levers; however, gas cylinder actuators suffer the drawback that with time they tend to lose their initial charge, with the consequence that the thrust provided is progressively reduced, to the point where they are no longer able to open the leaf or keep it completely open.

In order to overcome such drawback, various proposals have been made to use helical springs to replace gas cylinder actuators; however, since the elastic characteristic of helical springs between the compressed position and the extended position is linear and decreasing, when the spring is extended during the opening of the leaf there is a considerable reduction in the thrust, in particular when the leaf is brought to the fully open position, with the risk also that the spring may not be able to completely open the leaf or that the leaf could fall.

Therefore there is a need for a lifting system which is configured to overcome the above mentioned drawbacks.

The aim of the present invention is to provide a lifting system for leaves of furniture that oscillate about at least one horizontal axis, which is capable of durably driving the opening of the leaves and of reliably maintaining the completely open condition, thus guarding against the danger of accidental or unwanted closures.

Within this aim, an object of the present invention is to provide a lifting system for leaves of furniture that oscillate about at least one horizontal axis, which offers very reduced encumbrances and which can also be integrated with adapted hingeing means for the leaf, thus constituting a support and lifting assembly that is particularly compact and easy to install.

Another object of the present invention is to provide a lifting system for leaves of furniture that is highly reliable, easily and practically implemented and low cost.

This aim and these and other objects which will become better apparent hereinafter are achieved by a lifting system for leaves of furniture that oscillate about at least one horizontal axis between a closed position and a raised open position, the lifting system comprising a supporting body which can be connected to a fixed portion of the piece of furniture, a system of articulated levers which connect said supporting body to a leaf of the piece of furniture, said system of levers comprising a first lever which has an end connected rotatably to said supporting body by way of a rotation pin and a second lever which has an end that can be connected rotatably to an element for fixing on said leaf of the piece of furniture, said first lever and said second lever being mutually articulated at the respective other ends, and elastic actuation means which are functionally connected to said system of articulated levers in order to generate a rotation torque for said system of levers, characterized in that it comprises means for increasing said rotation torque, which cooperate with said elastic actuation means in order to increase said rotation torque at least along a portion of the oscillation in the direction for opening the leaf that includes the raised position of the leaf.

Further characteristics and advantages of the invention will become better apparent from the description of preferred but not exclusive embodiments of the invention, which are illustrated by way of non-limiting example in the accompanying drawings, wherein.

Figure 1:
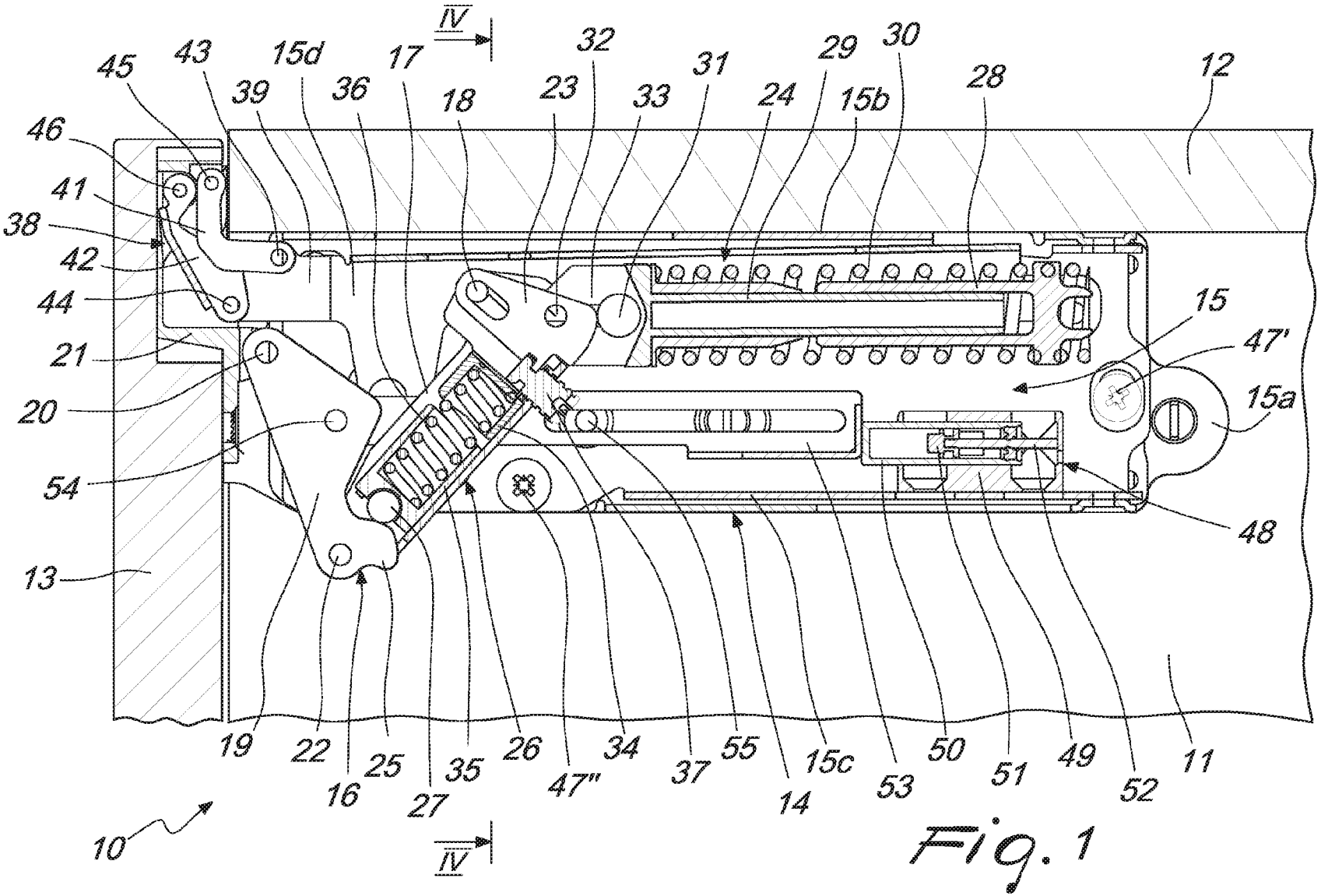
FIG. 1 is a longitudinal cross-sectional view of a lifting system for leaves of furniture that oscillate about at least one horizontal axis according to a preferred embodiment of the invention, in which a leaf is shown in the closed position.
Figure 2:
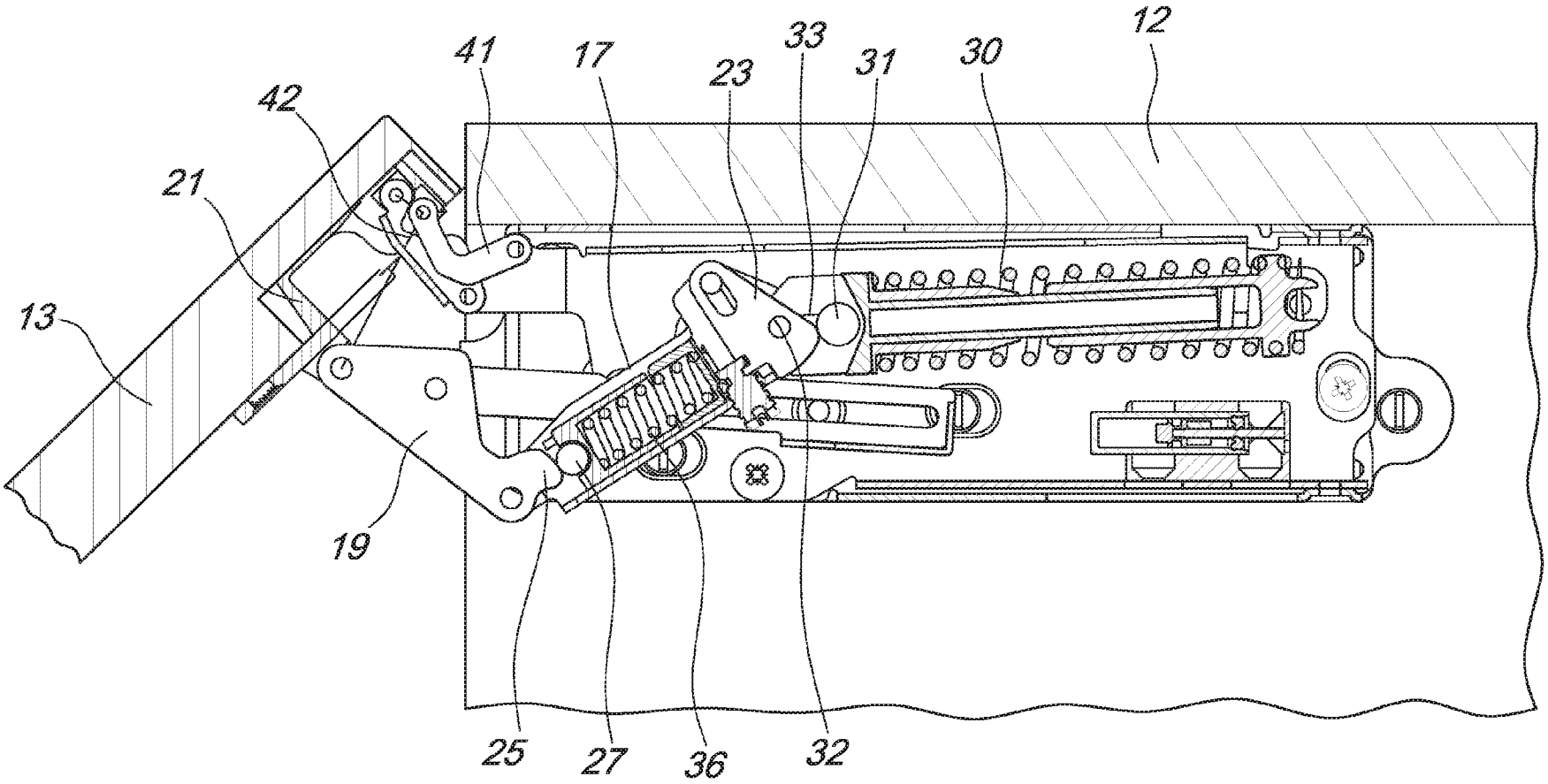
FIGS. 2 and 3 show the assembly of FIG. 1, in the same longitudinal cross-sectional view, with the leaf respectively in a partially open position and in the completely open position.

In the accompanying figures, in which identical reference numerals designate identical elements, a piece of furniture is shown, generally designated with the reference numeral 10, which comprises a side wall 11, an upper wall 12 and a leaf 13 which is supported so that it can oscillate about at least one horizontal axis by way of adapted hingeing means, as explained hereinafter.

In particular, the leaf 13 can move between a closed position, in which it lies on a vertical plane, and a raised open position, in which it lies on a substantially horizontal plane.

In order to drive the above mentioned opening movement, a lifting system, generally designated with the reference numeral 14, comprises a supporting body 15 which can be connected to a fixed portion of the piece of furniture, in particular to the side wall 11, and also comprises a system of articulated levers 16 which connect the supporting body 15 to the leaf 13 of the piece of furniture, and elastic actuation means that are functionally connected to the system of articulated levers 16 in order to generate a rotation torque for the system of levers, as explained hereinafter.

The system of levers 16 in turn comprises a first lever 17 which has an end connected rotatably to the supporting body 15 by way of a first rotation pin 18 and a second lever 19 which has an end that can be connected rotatably by way of a second rotation pin 20 to a fixing element 21 which can be applied to the leaf 13 of the piece of furniture; the first lever 17 and the second lever 19 are likewise mutually articulated at the respective other ends by way of an intermediate articulation pin 22.

In order to create a rotation torque for the system of levers 16, usually it is possible to connect elastic means between the supporting body 15 and a point of the first lever 17 that is located at a certain distance from the rotation pin 18 of the lever 17, so as to define a lever arm for the force of the elastic means which is such as to generate the aforementioned torque.

The oscillation of the lever 17 creates an increasing lever arm that adjusts the torque exerted by the elastic means to the opposing torque created by the leaf in its opening movement.

According to the present invention, the lifting system 14 comprises cam means on at least one of the levers 17, 19 of the system of articulated levers 16, and such cam means are shaped and arranged in order to suitably interact with the elastic actuation means in order to generate a further quantity of torque that, along at least one portion of oscillation of the leaf in the lifted position of the leaf 13, is added to the rotation torque for the system of levers that would be generated by the elastic means in the absence of such conveniently configured cam means.

In the preferred embodiment illustrated in the figures, the cam means comprise a first cam element 23 connected to the first lever 17 of the system of articulated levers 16, and such first element 23 interacts with first axially deformable elastic stress means 24 which are arranged between the supporting body 15 and the first lever 17 and are functionally connected to the first cam element 23.

Furthermore, preferably the cam means comprise a second cam element 25 connected to one of the first lever 17 or second lever 19 of the system of articulated levers 16, for example on the second lever 19 at the intermediate articulation pin 22, and such second element 25 interacts with second axially deformable elastic means 26 which are arranged on the other one of the first lever 17 or second lever 19 of the system of articulated levers, for example on the first lever 17, and which are functionally connected to the second cam element 25 by way of a sliding or rolling means 27 which is supported so that it can slide by the lever 17 provided with the second elastic means 26.

Preferably, the first elastic means 24 comprise a first portion 28 connected rotatably to the supporting body 15 and a second portion 29 connected to the first portion 28 so that it can slide along a longitudinal axis; in turn the second portion 29 is connected to the first lever 17 of the system 16 so that it can rotate and slide at a point of the first lever 17 that is spaced apart from the rotation pin 18 of the lever 17.

Between the first portion 28 and the second portion 29 at least one axially deformable elastic element, preferably a helical spring 30, is interposed.

There is furthermore a sliding or rolling means, preferably a roller 31, which is connected to the second portion 29, which is shaped and arranged so as to act on the first cam element 23.

Preferably, the rotatable and slideable connection between the second portion 29 of the first elastic means 24 and the first lever 17 of the system of levers 16 is obtained by way of a pivot 32, which is integral with the first lever 17 and more preferably with the first cam element 23 and is arranged at the aforementioned point of the lever 17 which is spaced apart from the rotation pin 18, and such pivot 32 is engaged so that it can slide and rotate in a fork 33 formed at the end of the second portion 29 of the elastic means which is directed toward the first lever 17.

Figure 3:
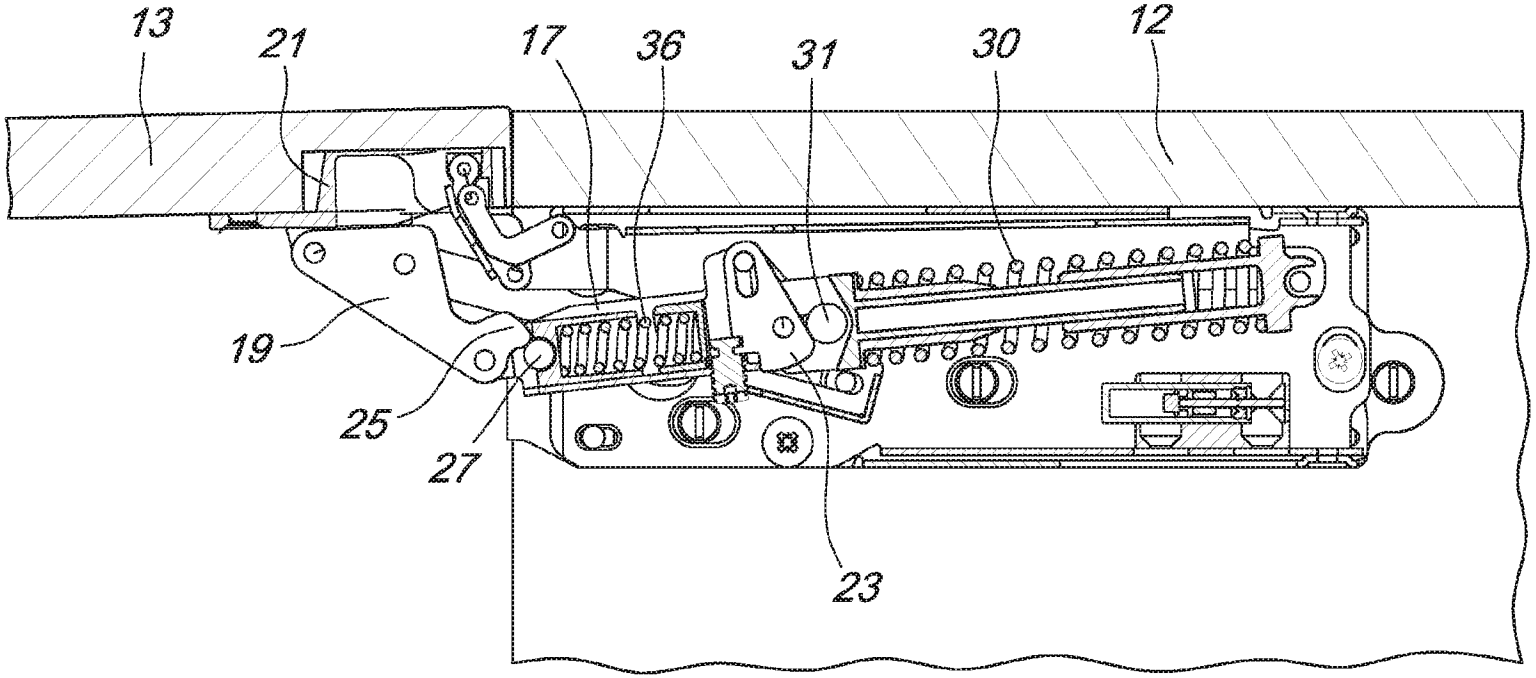

Thanks to such rotatable and slideable connection between the first elastic means 24 and the first lever 17 which has the first cam element 23, a first effect of multiplication and optimization of the rotation torque for the system of levers 16 is obtained, in that the roller 31 comes to exert a thrust on the first cam element 23 which, as a function of the angular position of the first lever 17, is oriented according to variable directions which are such as to maximize the lever arm of the thrust with respect to the pin 18 at least in the raised position of the leaf 13 in which the levers 17, 19, starting from the folded condition of the closed position of the leaf 13 of FIG. 1, are brought to an extended condition of FIG. 3.

A further effect of multiplication and optimization of the rotation torque for the system of levers 16 is obtained with the second cam element 25 connected for example to the second lever 19, in that such second element 25 interacts with second axially deformable elastic means 26 which are arranged on the other lever 17 of the system of articulated levers, for example on the first lever 17, and which are functionally connected to the second cam element 25 by way of a sliding or rolling means, for example a roller 27, which is supported so that it can slide by the lever 17 provided with the second elastic means 26.

Preferably, the second elastic means 26 comprise a first portion 34 and a second portion 35 for accommodating the elastic means which are connected to the first lever 17 of the system 16, where the second portion 35 is connected to the lever 17 so that it can slide along a longitudinal axis of that lever 17.

Between the first portion 34 and the second portion 35 at least one axially deformable elastic element, preferably a helical spring 36, is interposed.

The sliding or rolling means, preferably roller 27, is connected to the second portion 35, which is shaped and arranged so as to act on the second cam element 25.

Thanks to the second cam element 25 and to the second elastic means 26 which interact with it, it is possible to obtain an additional rotation torque for the system of levers 16, in particular a torque acting in the direction of opening in the fully open position of FIG. 3, but also preferably a torque acting in the direction of closing at the closed position of FIG. 1 in order to keep the leaf 13 closed, by conveniently shaping the cam element 25 so as to do work by way of release of the spring 36 at the aforementioned positions.

Preferably, such torque acting in the direction of closing at the closed position is obtained by conveniently shaping the second cam element 25 so that the force exerted by the spring 36, once a dead point defined by the cam has been passed, acts on the cam element 25 with a lever arm that tends to rotate the second lever 19 clockwise with respect to the pin 22 as shown in FIG. 1.

By contrast, when the leaf is opened, once the aforementioned dead point of the cam has been passed, the spring 36 exerts a force acting on the cam element 25 with an opposite lever arm with respect to the aforementioned lever arm which tends to rotate the second lever 19 anticlockwise with respect to the pin 22 of FIG. 1, thus producing a torque in the direction of opening of the leaf.

Preferably the first cam means 23 have adjustment means in order to be able to adapt the torque obtainable from the first elastic means 24 as a function for example of the weight of the leaf 13.

In such adjustment means for example the first cam element 23 can be connected to the first lever 17 so that it can slide approximately transversely with respect to the longitudinal axis of the lever 17 proper, for example by having the cam element 23 connected to the pin 18 by way of a slot, and there can be an actuation element, for example a screw or a threaded grub screw 37, for moving the first cam element 23 to the desired position.

In order to support the leaf 13 so that it can oscillate, the hingeing means comprise for example at least two hinges 38, each one of which in turn preferably comprises a fixed portion 39 which can be connected to the upper wall 12 or to a side wall 11 of the piece of furniture, a movable part that coincides with the fixing element 21 and which can be connected to the leaf 13, and at least a first arm 41 and a second arm 42 which connect the fixed portion 39, so that it can oscillate, with the movable portion respectively by way of at least a first 43, 44 and a second 45, 46 hingeing pin.

The hinges 38 can be separate elements, fixed to the piece of furniture independently of the lifting system 14, or, in a preferred embodiment, they can constitute an integrated assembly with the lifting system 14, for example by having the fixed portion 39 of the hinge 38 constituted by a front part or extension of the supporting body 15 of the lifting system 14 or by a part 15*d* of the supporting body 15 which is supported so that it can move and be adjusted with respect to the supporting body 15 proper.

Such integrated assembly has advantages, both in terms of space occupation, and in terms of mounting in respect of the separate application of the hinges and of the lifting systems.

From this perspective, more preferably the supporting body 15 is fixed so as to adhere to the side wall 11 and to the upper wall 12 proximate to the leaf 13.

Figure 5:
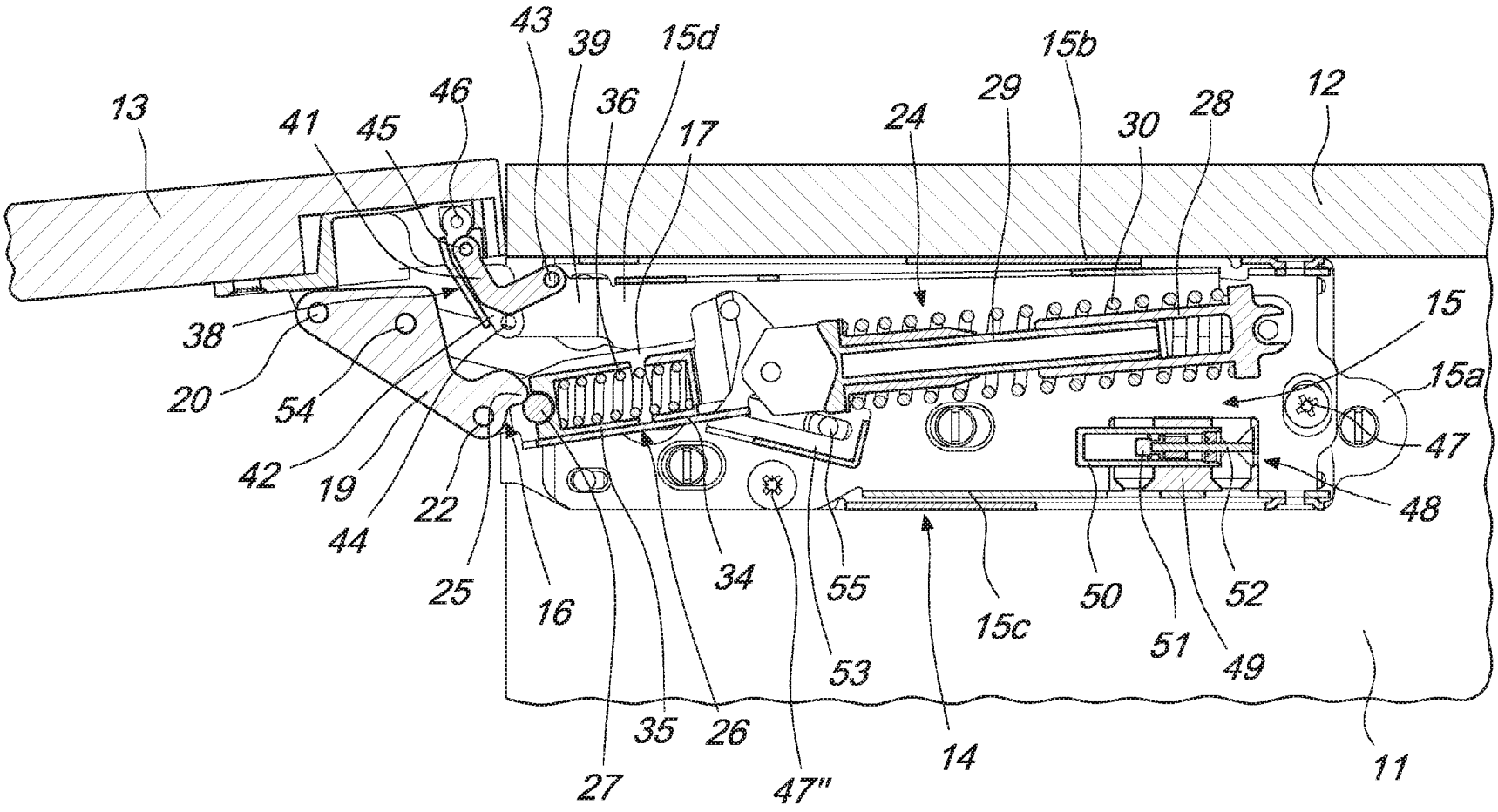
FIG. 5 is a longitudinal cross-sectional view of a variation of the lifting system according to the invention.

As an alternative to the preferred embodiment described above, assuming the presence of axially deformable elastic means arranged between the supporting body 15 and the first lever 17 of the system of levers 16 and functionally connected to the first lever 17, it is possible to have simplified embodiments, in which there is only one cam element which interacts either with the elastic means just mentioned (see FIG. 6) or with the second elastic means, if any, provided on one of the levers 17, 19 of the system of levers 16 (see FIG. 5).

Figure 6:
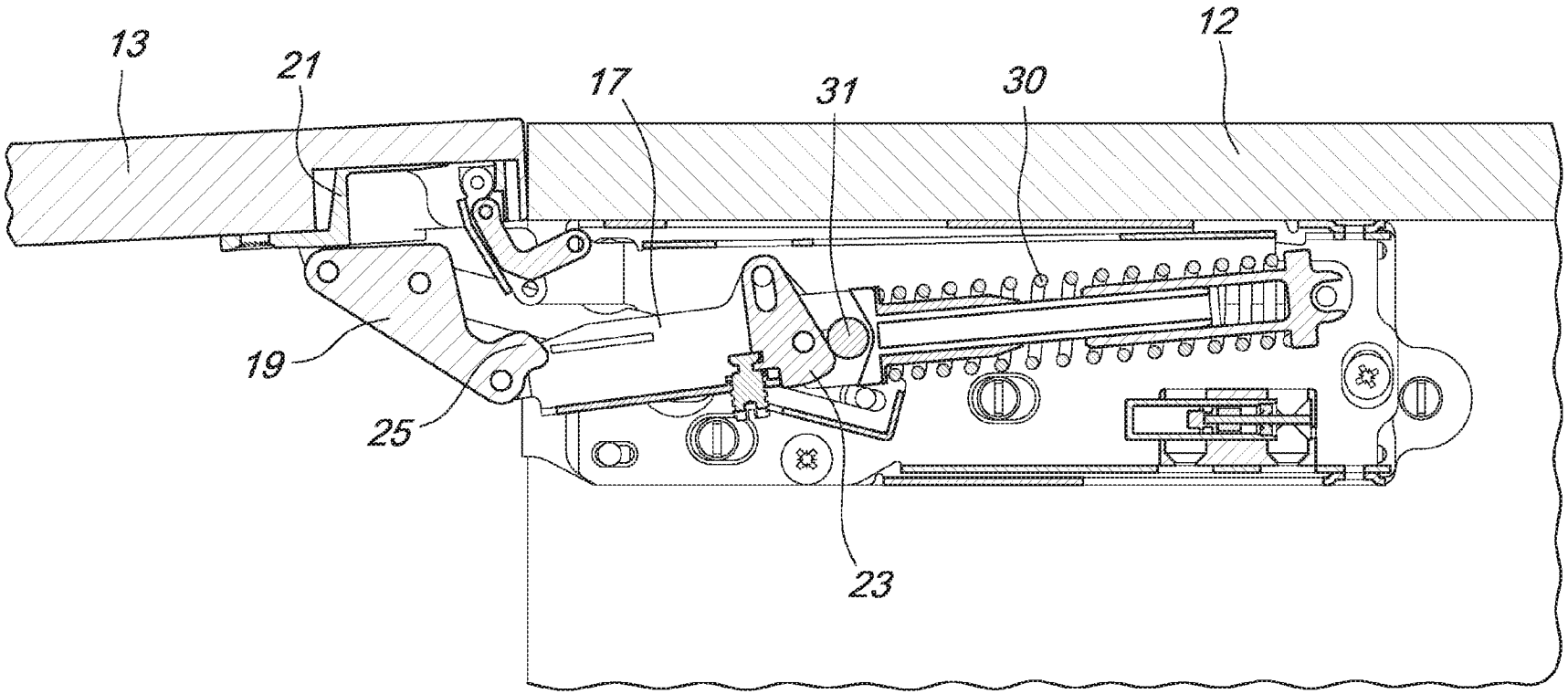
FIG. 6 is a longitudinal cross-sectional view of a second variation of the lifting system according to the invention.

In particular, a second embodiment is possible, as shown in FIG. 6, in which the cam means comprise only one cam element corresponding to the first cam element 23 of the embodiment described previously, connected to the first lever 17 of the system of articulated levers, and in which there are only the elastic actuation means arranged between the supporting body 15 and the first lever 17 and functionally connected to that cam element.

In such case, similarly to the embodiment described previously, the elastic means comprise a first part connected rotatably to the supporting body, and a second part connected to the first part so that it can slide along a longitudinal axis, where the second part is connected to the first lever of the system so that it can rotate and slide at a point of the first lever that is spaced apart from the rotation pin of that lever.

Also, the elastic means comprise at least one axially deformable elastic element interposed between the first and the second part, and a sliding or rolling means which is connected to the second part, and shaped and arranged so as to act on the cam means.

Such second embodiment does not have further elastic means arranged on the levers of the system of levers, nor does it have further cam means which interact with them; therefore what is obtained is an effect of multiplication and optimization of the rotation torque for the system of levers 16 which derives mainly from the rotatable and slideable connection between the elastic means and the first lever 17 which has the first cam element.

As mentioned above, another simplified embodiment is possible, in which there is only one cam element which interacts with second elastic means that are provided on one of the levers of the system of levers.

In particular, as shown in FIG. 5, a third embodiment is possible in which the elastic actuation means comprise first axially deformable elastic means which are arranged between the supporting body and the first lever of the system of articulated levers and are functionally connected to the first lever directly without having the first cam means of the embodiments described previously; instead, there are cam means which are constituted by a cam element, corresponding to the cam element 25 of the first embodiment, which is connected to one of the levers of the system of articulated levers and interacts with second axially deformable elastic means which are arranged on the other one of the levers of the system of articulated levers and are functionally connected to the cam element by way of a sliding or rolling means which is supported so that it can slide by the lever which has the second elastic means.

Thanks to such cam element and to the second elastic means which interact with it, it is possible to obtain an additional rotation torque for the system of levers, which is added to the torque obtainable from the first elastic means which interact directly with the first lever.

Preferably the elastic elements are constituted by one or more helical compression springs, but the possibility is not ruled out of employing elastic means of different type, for example one or more helical traction springs associated with a structure for supporting the springs which is in any case such as to provide an axial extension thrust.

In order to allow an adjustment of the position of the leaf 13 with respect to the body 11, 12 of the piece of furniture, preferably there are suitable adjustment means associated with the supporting hinges or with the assembly for supporting and lifting the leaf 13.

Figure 4:
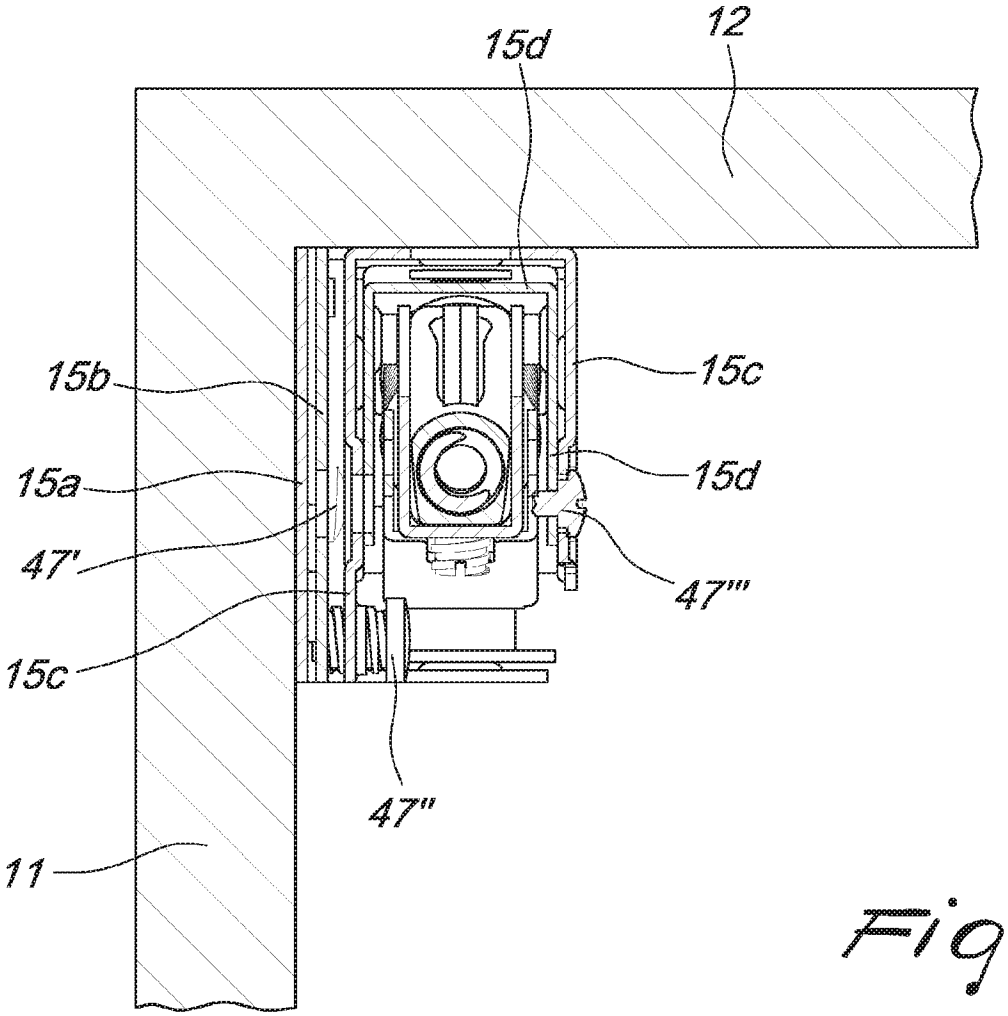
FIG. 4 is a cross-sectional view of FIG. 1 taken along the line IV-IV.

In particular, as better illustrated in FIGS. 1 and 4 of the lifting system, preferably in such adjustment means the supporting body 15 is formed by a first part 15*a* which is fixed to the side wall 11 and/or to the upper wall 12 of the piece of furniture, by a second part 15*b* which is connected to the first 15*a* so that it can move and be adjusted according to a first direction, for example frontal, by way of a first eccentric element 47', by a third part 15*c* which is connected to the second 15*b* so that it can move and be adjusted according to a second direction, for example lateral, by way of a screw 47", and by a fourth part 15*d* which is connected to the third 15*c* so that it can move and be adjusted according to a third direction, for example vertical, by way of a second eccentric element 47'".

In this manner, the leaf 13 can be simply adjusted frontally, laterally and vertically with respect to the body of the piece of furniture, by actuating, manually or by way of tools, the actuation means provided, in particular the eccentric elements 47', 47'" and the screw 47".

Preferably, the lifting system 14 comprises a deceleration device 48, for example a fluid-operated linear decelerator or a rotary decelerator, for decelerating the closing movement of the leaf 13 in the neighborhood of the fully closed position.

In the preferred solution shown, the deceleration device 48 comprises a fluid-operated linear decelerator arranged in the supporting body 15, which has a receptacle 49 in which a cylinder 50 containing a fluid, for example oil, is moveably inserted; inside the cylinder 50 there is a slideable piston 51 with a rod 52 which juts out from the cylinder 50 in order to come into contact with a rear wall of the receptacle 49.

For actuating the linear decelerator, there is a moveable actuation element 53 which is functionally connected to a lever of the system of articulated levers 16, preferably to the second lever 19 by way of a hingeing pin 54, and is connected so that it can slide with a pivot 55 which is integral with the supporting body 15, so as to confer a movement with a linear component on the actuation element 53 during the closing of the leaf 13 in order to actuate the decelerator 48.

In practice it has been found that the lifting system for leaves of furniture according to the present invention fully achieves the set aim and objects, in that it is capable of driving the complete opening of the leaves and of reliably maintaining such completely open condition, thus guarding against the danger of accidental closures.

The lifting system for leaves of furniture according to the invention is susceptible of numerous modifications and variations, all of which are within the scope of the appended claims. Moreover, all the details may be substituted by technically equivalent elements.

In practice the materials employed, and the contingent shapes, may be any according to requirements and to the state of the art.

The disclosures in Italian Patent Application No. MI2015A000221 (102015902330881) from which this application claims priority are incorporated herein by reference.

The invention claimed is:

1. A lifting system that oscillate about at least one horizontal axis between a closed position and a raised open position, the lifting system comprising a supporting body that is configured to connect to a fixed portion of a piece of furniture, a system of articulated levers which are configured to connect said supporting body to a leaf of the piece of furniture, said system of levers comprising a first lever which has a first end directly connected rotatably to said supporting body by way of a rotation pin and a second lever which has a first end that is configured to directly connect rotatably to an element for fixing on said leaf of the piece of furniture, said first lever and said second lever being mutually articulated at respective second ends and elastic actuation means that are configured to connect to said system of articulated levers in order to generate a rotation torque for said system of levers, comprising means for increasing said rotation torque, which cooperate with said elastic actuation means in order to increase said rotation torque at least along a portion of the oscillation in a direction for opening the leaf between the closed position and the raised open position wherein said means for increasing the torque comprise cam means provided on at least one of the first lever and the second lever, wherein said cam means comprise:

a first cam element connected to said first lever, said elastic actuation means comprising first axially deformable elastic means, said first axially deformable elastic means connected to said first cam element and said first axially deformable elastic means arranged between said supporting body and said first end of said first lever, wherein said second end of said first lever opposes the first end of said first lever, a second cam element connected to said second lever, said elastic actuation means comprising second axially deformable elastic means, which are connected to said second cam element by way of a first sliding or rolling means configured to slide by the second lever, and wherein said second axially deformable elastic means is between said first end of said first lever and said said second cam element.

2. The lifting system according to claim 1, wherein said first elastic means comprise:

a first portion, connected rotatably to said supporting body, a second portion, connected to said first portion, said second portion configured to slide along a longitudinal axis, said second portion being connected furthermore to said first lever of the system, the second portion also configured to rotate and slide at a point of the first lever that is spaced apart from the rotation pin of said first lever, at least one axially deformable elastic element, interposed between said first portion and said second portion, and a second sliding or rolling means connected to said second portion, shaped and arranged so as to act on said first cam element.

3. The lifting system according to claim 1, wherein said first sliding or rolling means is a roller which is shaped and arranged so as to act on said second cam element.

4. The lifting system according to claim 1, wherein said sliding and rotating connection between the second portion of the first elastic means and the first lever of the system of levers is provided with a pivot which is integral with said first lever, said pivot configured to slide and rotate in a fork formed at the end of said second portion of the elastic means which is directed toward the first lever.

5. The lifting system according to claim 1, wherein said second axially deformable elastic means comprise a first portion and a second portion for accommodating the elastic means which are connected to said first lever of the system of levers, said second portion being connected to the first lever and being configured to slide along a longitudinal axis of said first lever, wherein at least one axially deformable elastic element is interposed between said first portion and said second portion.

6. The lifting system according to claim 1, wherein said cam means connected to said first lever of the system of articulated levers have adjustment means for adjusting the position of said cam means with respect to the first lever.

7. The lifting system according to claim 6, wherein in said adjustment means the cam means are connected to the first lever, the cam means being configured to slide transversely with respect to the longitudinal axis of said first lever and have an actuation element that is configured to move the cam means with respect to said first lever.

8. The lifting system according to claim 1, wherein said axially deformable elastic means comprise one or more helical compression springs.

9. The lifting system according to claim 1, further comprising a deceleration device shaped and arranged to decelerate the closing movement of the leaf, between the raised open position and the closed position, when the lifting system is near the closed position.

10. The lifting system according to claim 9, wherein said deceleration device comprises a fluid-operated linear decelerator arranged in said supporting body, the fluid-operated linear decelerator configured to be actuated by a moveable actuation element which is connected to a lever of the system of articulated levers.

11. A support and lifting assembly, comprising:

a lifting system according to claim 1, and means for hinging between the supporting body of said lifting system and a leaf of the piece of furniture, said hinging means comprising a moveable hinge part that is configured to be fixed to the leaf of the piece of furniture, said movable hinge part being configured to oscillate to the supporting body by way of connection means comprising at least one hinging pin.

12. The support and lifting assembly according to claim 11, wherein said means for connection between said supporting body and said moveable hinge portion comprise at least a first and a second oscillating arm, each of which is provided with a first and a second hinging pin, which are connected respectively to said supporting body and to said moveable hinge portion.

13. The support and lifting assembly according to claim 11, further comprising adjustment means for said leaf.

14. The support and lifting assembly according to claim 13, wherein said adjustment means comprise a supporting body formed by a plurality of parts which are mutually connected in a moveable and adjustable manner along at least two mutually transverse directions in order to move the leaf vertically, laterally and/or frontally with respect to the fixed portion of the piece of furniture.

* * * * *